US005375975A

United States Patent [19]

Yu et al.

[11] Patent Number: 5,375,975

[45] Date of Patent: Dec. 27, 1994

[54] FUEL PUMP PRE-SWIRL INLET CHANNEL

[75] Inventors: Dequan Yu, Ann Arbor; Robert D. Gaston, Dearborn Heights, both of Mich.

[73] Assignee: Ford Motor Company, Dearborn, Mich.

[21] Appl. No.: 173,228

[22] Filed: Dec. 27, 1993

[51] Int. Cl.[5] ..... F04D 29/40

[52] U.S. Cl. ..... 415/182.1; 415/55.1

[58] Field of Search ..... 415/55.1, 55.2, 182.1, 415/200

[56] References Cited

U.S. PATENT DOCUMENTS

| | | | |
|---|---|---|---|
| 2,394,931 | 2/1946 | Mueller | 415/182.1 |
| 3,311,292 | 3/1967 | Connor . | |
| 3,735,782 | 5/1973 | Strascheletzky . | |
| 3,936,243 | 2/1976 | Gakenholz . | |
| 4,080,096 | 3/1978 | Dawson . | |
| 4,880,352 | 11/1989 | Aarestad . | |
| 4,915,582 | 4/1990 | Nishikawa | 415/55.1 |

*Primary Examiner*—John T. Kwon

*Attorney, Agent, or Firm*—David B. Kelley; Roger L. May

[57] ABSTRACT

A fuel pump has a motor mounted within a housing with a shaft extending therefrom to which a helically shaped impeller is fitted for pumping fuel from a fuel tank to an automotive engine. An end section of the housing has an inlet leading from the fuel tank to a pre-swirl fuel channel or trough located at the radially outermost perimeter of an impeller mating face on the end section. The trough has an inlet ramp which routes fuel to an inclined section with an axial grade to force the fuel to flow in the direction of impeller rotation. A trough termination ramp between the inclined section and the inlet ramps fuel toward the impeller at a steeper grade than the inclined section such that the fuel trough becomes flush with the impeller mating face. Fuel can thus be picked-up by the impeller throughout at least 340° of rotation.

15 Claims, 2 Drawing Sheets

FUEL PUMP PRE-SWIRL INLET CHANNEL

FIELD OF THE INVENTION

The present invention relates to automotive fuel pumps, and, more particularly, to an inlet for a fuel pump with a helical impeller which allows fuel pick-up throughout at least 340° of travel.

BACKGROUND OF THE INVENTION

Electric fuel pump designs have evolved to a steady design state of employing gerotors, roller vanes, or modified fluid turbine principles for generating high fuel pressure in essentially all current vehicle applications. Fuel is picked-up by such fuel pumps over an arc extending between 60° and 120° around a pumping channel formed along the pumping element circumference. Low pressure and high pressure regions are thus created at the fuel inlet and fuel outlet, respectively, which are at opposite ends of the channel. Since the pumping channel terminates abruptly at the outlet, a pulsing effect is created as the pumping element rotates past the non-channel circumferential portion of the pump housing. These hydraulic pulsations result in decreased pump efficiency since high energy fuel either is carried from the high pressure side to the low pressure side or leaks across. In addition, prior fuel pump inlets have a sudden pressure decrease in the vacuum stage leading to the pumping channel inlet thus creating turbulence and enhancing the conditions which promote undesirable cavitation. These prior inlets also had a secondary backflow which reduced pump efficiency.

Other pumps, such as that disclosed in U.S. Pat. No. 4,880,352 (Aarestad), have side inlets, as opposed to the end inlet of the present invention, which do not ramp fuel into the impeller inlet channel. In addition, the pump shown in the Aarestad patent picks up fuel through only 180° as opposed to at least 340° for the present invention.

SUMMARY OF THE INVENTION

The present invention enhances axial fuel flow into a fuel pump by advantageously employing the vortex characteristics of a rotating helical impeller by channeling the fuel through a pre-swirl fuel channel or trough which extends circumferentially around an end section of the fuel pump and gradually becomes shallower so that fuel is forced or ramped into the impeller inlet throughout at least 340° of impeller travel. Such a structure induces a pre-swirl condition in the fuel; that is, fuel flowing through the inlet is channeled into the fuel trough and forced to flow in the direction of impeller rotation prior to entering the impeller inlet. This pre-swirl action reduces the turbulence of fuel entering the impeller and reduces or eliminates the secondary backflow characteristic of prior pumps. In addition, the ramped nature of the fuel trough reduces gradually increases inlet fuel pressure prior to being scooped into the impeller inlet thus eliminating the undesirable pulsing commonly experienced with prior pumps, such as those discussed above.

The advantages just discussed are accomplished by providing a fuel pump for supplying fuel from a fuel tank to an automotive engine, the fuel pump comprising a pump housing with a motor mounted within a motor chamber within the housing and having a shaft extending therefrom. A helically shaped pumping element is fitted to the shaft between an end section of the housing and the motor for pumping fuel in a generally axial direction from the tank, through an inlet in the end section, into the motor chamber, and through an outlet leading to said engine. The end section has a fuel trough on an outer perimeter of an impeller mating face thereof beginning and ending at the inlet, with the trough having an axial grade toward the impeller so as to become gradually shallower with respect to the impeller mating face and becomes flush with the impeller mating face after approximately 340° to 360° of arc from the inlet. Preferably, the fuel trough has an inlet ramp leading from the inlet to an inclined section having a lesser axial grade toward the impeller than the inlet ramp, and a trough termination ramp between the inclined section and the inlet having a steeper axial grade toward the impeller than the inclined section. The fuel trough also cooperates with the impeller and the inlet to force fuel to flow through the inlet and into the fuel trough in the direction of impeller rotation prior to entering the impeller inlet in the impeller.

In the preferred embodiment, the inlet ramp has an axial grade toward the impeller of between 4° and 8°, the inclined section has an axial grade toward the impeller of between 1° and 3°, and the trough termination ramp has an axial grade toward the impeller of between 4° and 8°. The inlet ramp extends from the inlet between approximately 6° and 10° along the perimeter of the impeller mating face of the end section to the inclined section. The trough termination ramp extends from the inclined section between approximately 6° and 10° along the perimeter of the impeller mating face of the end section to the inlet.

DETAILED DESCRIPTION OF THE PREFERRED EMBODIMENT

Figure 1:
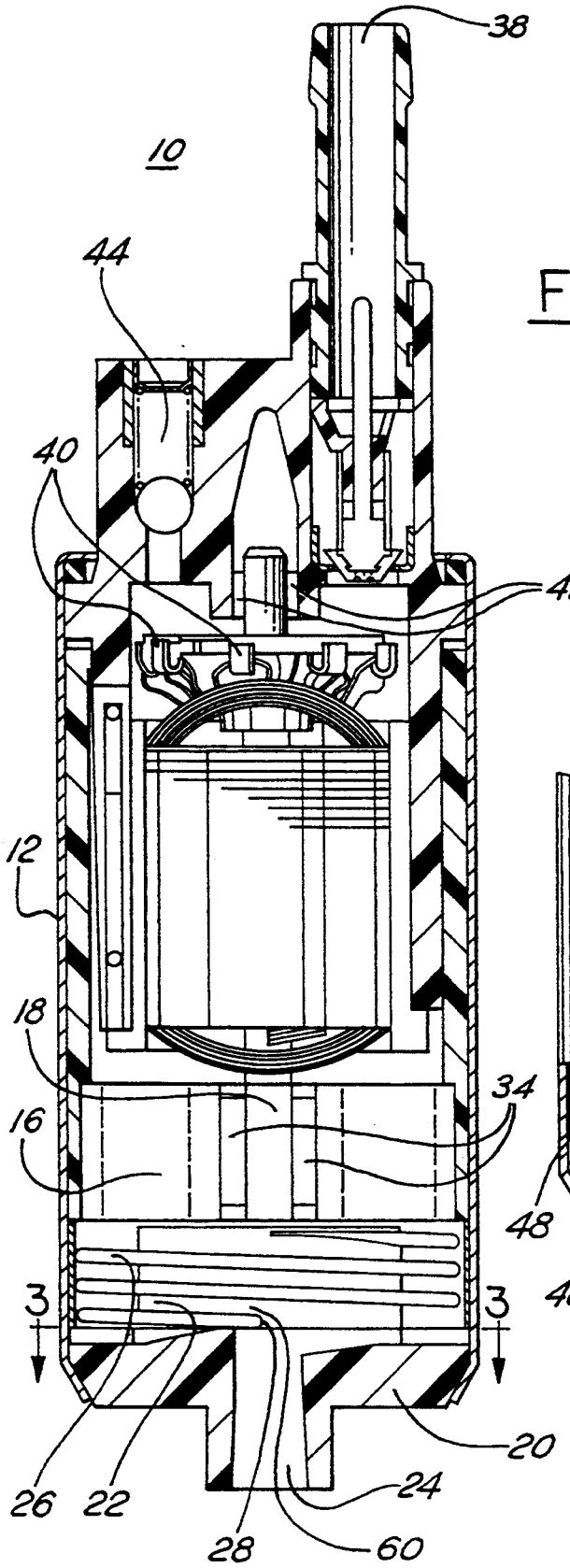
FIG. 1 is a cross-sectional view of a fuel pump according to the present invention.
Figure 2:
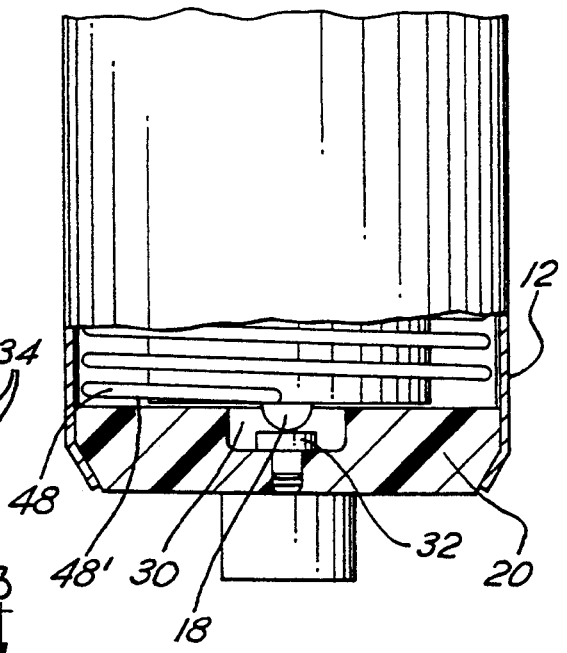
FIG. 2 is a cross-sectional view of a pumping end portion of a fuel pump according to the present invention along the center of the pump.

A cross-sectional view of fuel pump 10 is shown in FIG. 1. Fuel pump 10 has a housing 12 for containing its inner components. A motor 14, preferably an electric motor, is mounted within motor space 16 and has shaft 18 extending therefrom in the direction of end section 20. Motor 14 is preferably driven by brushed or brushless means, but is not confined to such. A helically shaped rotary pumping element, preferably a helical impeller 22, is fitted on shaft 18 near end section 20. Impeller 22 has a central axis which is coincident with the axis of shaft 18. End section 20 has inlet 24 therein running generally in the direction of an axis parallel to shaft 18. Helical impeller 22 comprises a helical blade 26 having a leading edge 28 which travels in an approximately perpendicular direction to an axis through inlet 24 and parallel to shaft 18. As seen in FIG. 2, shaft 18 passes through impeller 22, into recess 30 of end portion 20, and abuts thrust button 32. A thrust bearing (not shown) can be used in place of a thrust button. Shaft 18 is journalled within bearing 34 (FIG. 1).

Pressurized fuel is discharged from impeller 22 to motor space 16 and cools motor 14 while passing over it to pump outlet 38 at an end of pump 10 axially opposite inlet 24, as shown in FIG. 1. The fuel also cleans and cools motor commutator 40, motor upper bearings 42, and the motor brushes (not shown). Check valve 44 opens to lower system pressure into tank 10 should motor space 16 become overpressurized.

Figure 3:
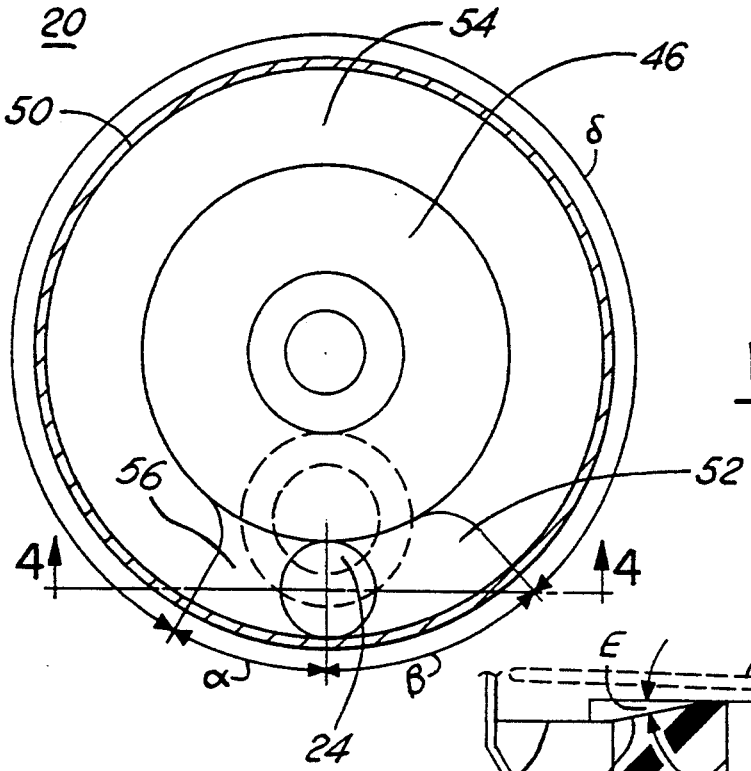
FIG. 3 is an inside view of the end section of a fuel pump according to the present invention along line 3—3 of FIG. 1.
Figure 4:
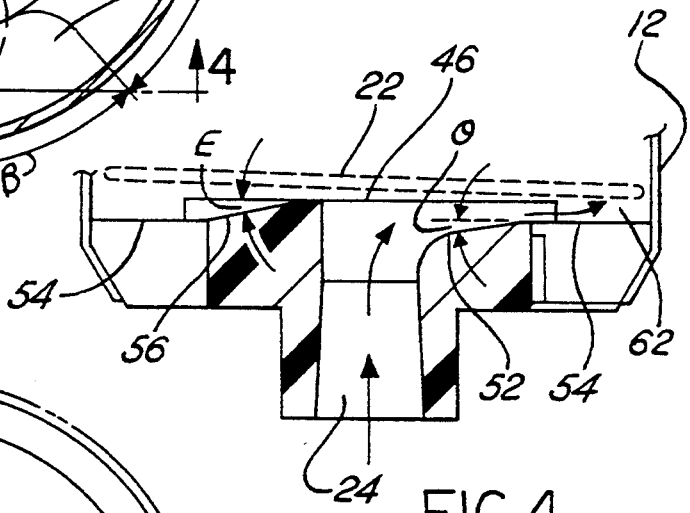
FIG. 4 is a cross-sectional view of the end section of a fuel pump according to the present invention along line 4—4 of FIG. 3 showing the inlet and exit ramps.

FIG. 3 shows an inside view of end section 20 along line 3—3 of FIG. 1. End section 20 has an impeller mating face 46 which mates with a back side 48' of first turn 48 of impeller 22, as seen in FIG. 2. Referring again to FIG. 3, impeller mating face 46 has a fuel trough 50 on a radially outer perimeter thereof, preferably extending from inlet 24 at least 340° around impeller mating face 46 back to inlet 24. Fuel trough 50 is comprised of inlet ramp 52 which has an axial grade $\theta$ toward impeller 22 (FIG. 4). That is, the surface of inlet ramp 52 becomes closer to impeller 22 as the radially outermost circumference, or perimeter, of fuel trough 50 is traversed in a counterclockwise direction beginning at inlet 24 (FIGS. 3 and 4). Preferably, inlet ramp 52 has an axial grade $\theta 0$ toward impeller 22 of between approximately 4° and 8° (FIG. 4), and extends an angle $\beta$ from inlet 24 between approximately 6° and 10° along the perimeter of impeller mating face 46 of end section 20 to an inclined section 54 (FIG. 3).

Inclined section 54 has a lesser axial grade toward impeller 22 than inlet ramp 52, preferably between approximately 1° to 3°. Additionally, inclined section 54 extends an angle $\delta$ approximately 340° to 348° from inlet 24 around the radially outermost portion of end section 20 to a trough termination ramp 56 (FIGS. 3 and 4).

Trough termination ramp 56 extends between inclined section 54 and inlet 24, also around a radially outermost portion of end section 20, and has a steeper axial grade $\epsilon$ toward impeller 22 than inclined section 54, as seen in FIG. 4. Preferably, trough termination ramp 56 has an axial grade $\epsilon$ toward impeller 22 of between approximately 4° and 8°, and extends an angle $\alpha$ between approximately 6° and 10° along the perimeter of impeller mating face 46 of end section 20 from inclined section 54 to inlet 24. As shown in FIG. 4, trough termination ramp 56 is ramped from inclined section 54 so as to become flush with impeller mating face 46.

Figure 5:
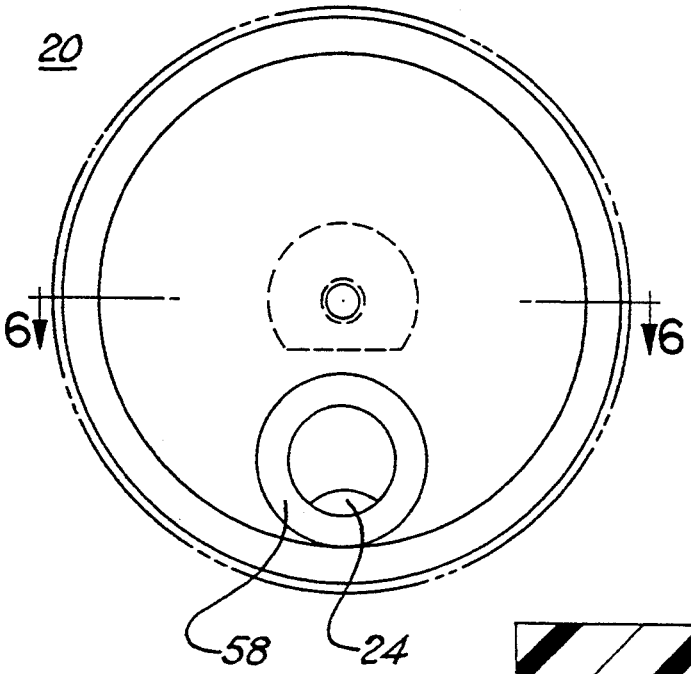
FIG. 5 is an outside view of an end section of a fuel pump according to the present invention.
Figure 6:
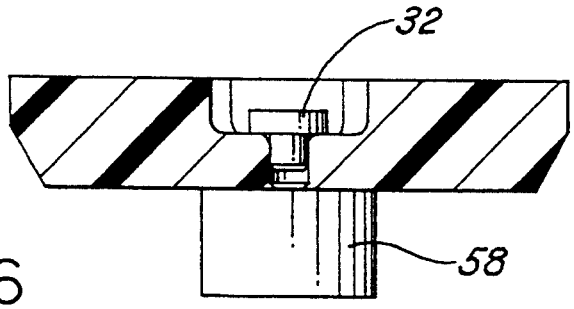
FIG. 6 is a cross-sectional view of an end section of a fuel pump according to the present invention along line 6—6 of FIG. 5.

FIG. 5 is an outside view of end section 20 showing inlet 24 and inlet extension 58. FIG. 6 shows a cross-sectional view of end section 20 along line 6—6 of FIG. 5.

In operation, fuel is drawn into fuel extension 58 when impeller 22 passes over inlet 24 (FIG. 1). Fuel flows toward impeller 22 and is routed by inlet ramp 52 and back side 48' of first turn 48 of impeller 22 into fuel trough 50 (FIGS. 2 and 4). As impeller 22 rotates, fuel is scooped from fuel trough 50 into impeller inlet 60 (FIG. 1). Fuel which is not scooped into impeller inlet 60 flows into inclined section 52 of fuel trough 50 and is drawn through trough 50 around the outer circumference of impeller mating face 46. A pre-swirl condition in the fuel is thus created. That is, fuel flowing through inlet 24 is channeled into fuel trough 50 and forced to flow in the direction of impeller 22 rotation prior to entering the impeller inlet 60. This pre-swirl action reduces the turbulence of fuel entering the impeller and reduces or eliminates the secondary backflow characteristic of prior pumps. Since inclined section 52 has an axial grade toward impeller 22, the cross-sectional area 62 (FIG. 4) of trough 50 becomes smaller as fuel flows toward trough termination ramp 54. As a result, the fuel pressure in trough 50 gradually increases in a smooth fashion, unlike prior pumps which have abrupt fuel pressure increases. Thus, pump efficiency is increased because the more gradual inlet fuel pressure rise prior to fuel entering impeller inlet 62 decreases pump pulsing effects and cavitation.

End section 20 is preferably integrally molded, for example, injection molded, as a single piece using glass filled polymers or multi-property polymers (terpolymers) or other plastic, thermoplastic, or non-plastic materials known to those skilled in the art and suggested by this disclosure. Alternatively, end section 20 can be machined out of lightweight aluminum using computerized numeric control (CNC) methods.

Although the preferred embodiment of the present invention has been disclosed, various changes and modifications may be made without departing from the scope of the invention as set forth in the appended claims.

We claim:

1. A fuel pump for supplying fuel from a fuel tank to an automotive engine, comprising:

a pump housing;

a motor mounted within a motor chamber within said housing and having a shaft extending therefrom;

a helically shaped pumping element fitted to said shaft between an end section of said housing and said motor for pumping fuel in a generally axial direction from said tank, through an inlet in said end section, to said motor chamber, and to an outlet leading to said engine; and a fuel trough beginning and ending at said inlet and extending at least 340° around an outer perimeter of an impeller mating face on said end section, said fuel trough having an axial grade toward said impeller so as to become flush with said impeller mating face at said inlet, said fuel trough also cooperating with said impeller and said inlet to force fuel to flow through said inlet and into said fuel trough in the direction of impeller rotation prior to entering an impeller inlet in said impeller.

2. A fuel pump for supplying fuel from a fuel tank to an automotive engine, comprising:

a pump housing;

a motor mounted within a motor chamber within said housing and having a shaft extending therefrom;

a helically shaped pumping element fitted to said shaft between an end section of said housing and said motor for pumping fuel in a generally axial direction from said tank, through an inlet in said end section, to said motor chamber, and to an outlet leading to said engine; and a fuel trough on an outer perimeter of an impeller mating face of said end section, said fuel trough having an inlet ramp leading from said inlet to an inclined section having a lesser axial grade toward said impeller than said inlet ramp, and a trough termination ramp between said inclined section and said inlet having a steeper axial grade toward said impeller than said inclined section so that said trough termination ramp becomes flush with said impeller mating face.

3. A fuel pump according to claim 2 wherein said inlet ramp has an axial grade toward said impeller of between approximately 4° and 8°.

4. A fuel pump according to claim 3 wherein said inclined section has an axial grade toward said impeller of between approximately 1° and 3°.

5. A fuel pump according to claim 4 wherein said trough termination ramp has an axial grade toward said impeller of between approximately 4° and 8°.

6. A fuel pump according to claim 2 wherein said inlet ramp extends from said inlet between approximately 6° and 10° along the perimeter of said impeller mating face of said end section to said inclined section.

7. A fuel pump according to claim 2 wherein said trough termination ramp extends from said inclined section between approximately 6° and 10° along the perimeter of said impeller mating face of said end section to said inlet.

8. A fuel pump according to claim 2 wherein said end section is integrally molded from a thermoplastic material.

9. A fuel pump for supplying fuel from a fuel tank to an automotive engine, comprising:

a pump housing;

a motor mounted within a motor chamber within said housing and having a shaft extending therefrom;

a helically shaped pumping element fitted to said shaft between an end section of said housing and said motor for pumping fuel in a generally axial direction from said tank, through an inlet in said end section, to said motor chamber, and to an outlet leading to said engine, with said pumping element being toleranced so as not to contact said pump housing; and a fuel trough extending at least 340° around an outer perimeter of an impeller mating face of said end section, said fuel trough having an inlet ramp leading from said inlet to an inclined section having a lesser axial grade toward said impeller than said inlet ramp, and a trough termination ramp between said inclined section and said inlet having a steeper axial grade toward said impeller than said inclined section so that said trough termination section becomes flush with said impeller mating face, said fuel trough cooperating with said impeller and said inlet to force fuel to flow from through said inlet and into said fuel trough in the direction of impeller rotation prior to entering an impeller inlet.

10. A fuel pump according to claim 9 wherein said inlet ramp has an axial grade toward said impeller of between 4° and 8°.

11. A fuel pump according to claim 10 wherein said inclined section has an axial grade toward said impeller of between 1° and 3°.

12. A fuel pump according to claim 11 wherein said trough termination ramp has an axial grade toward said impeller of between 4° and 8°.

13. A fuel pump according to claim 9 wherein said inlet ramp extends from said inlet between approximately 6° and 10° along the perimeter of said impeller mating face of said end section to said inclined section.

14. A fuel pump according to claim 9 wherein said trough termination ramp extends from said inclined section between approximately 6° and 10° along the perimeter of said impeller mating face of said end section to said inlet.

15. A fuel pump according to claim 9 wherein said end section is integrally molded from a thermoplastic material.

* * * * *